US011998156B2

(12) United States Patent
Ryu

(10) Patent No.: US 11,998,156 B2
(45) Date of Patent: Jun. 4, 2024

(54) DISHWASHER FIXING BRACKET APPARATUS

(71) Applicant: Sung Won Ryu, Oakland Garden, NY (US)

(72) Inventor: Sung Won Ryu, Oakland Garden, NY (US)

( * ) Notice: Subject to any disclaimer, the term of this patent is extended or adjusted under 35 U.S.C. 154(b) by 429 days.

(21) Appl. No.: 17/336,768

(22) Filed: Jun. 2, 2021

(65) Prior Publication Data

US 2022/0386845 A1 Dec. 8, 2022

(51) Int. Cl.
*A47L 15/42* (2006.01)

(52) U.S. Cl.
CPC ..... *A47L 15/427* (2013.01)

(58) Field of Classification Search
CPC ..... A47L 15/427; A47B 96/067; A47B 96/14
See application file for complete search history.

(56) References Cited

U.S. PATENT DOCUMENTS 3,182,805 A * 5/1965 Foster, Jr. et al. ..... H05K 7/183 248/57
4,469,384 A * 9/1984 Fler ..... A47B 88/493 312/333
8,763,965 B1 * 7/2014 Peay ..... A47L 15/427 248/300
9,510,726 B1 * 12/2016 Peay ..... A47L 15/427
11,116,381 B2 * 9/2021 Strahle ..... G08B 5/32
2016/0353601 A1 * 12/2016 Sampath ..... A47B 96/1441

FOREIGN PATENT DOCUMENTS

WO WO 2012034673 A1 * 3/2012 ..... A47B 96/06

* cited by examiner

*Primary Examiner* — James O Hansen
(74) *Attorney, Agent, or Firm* — The PL Law Group, PLLC

(57) ABSTRACT

A dishwasher fixing bracket apparatus may include a base bar and moving plates. The base bar has a flat top surface, and includes a slide rail on a bottom thereof to extend in a longitudinal direction. The moving plates are slidably coupled to the slide rail and are configured to change positions thereof on the base bar in the longitudinal direction of the base bar. The moving plates include a pair of outer plates and one or more inner plates. The outer plates respectively include a support strap protruding toward the corresponding distal end of the base bar. The support strap has a coupling hole through which the support strap is coupled to an external structure and is oriented toward the adjacent distal end of the base bar. The inner plates slide between the outer plates and having fixing holes through which the inner plates are coupled to the dishwasher.

8 Claims, 10 Drawing Sheets

DISHWASHER FIXING BRACKET APPARATUS

BACKGROUND

1. Field of the Invention

The present disclosure relates generally to a bracket apparatus, and more particularly, to a dishwasher fixing bracket apparatus for fixing a dishwasher in a place in which the dishwasher is installed.

2. Description of the Related Art

Home appliances serve to improve the quality of life of humans by performing time-consuming chores in place of humans. In particular, the use of automatic washers that perform daily chores, such as clothes washing or dish washing in kitchens in place of humans, has significantly increased leisure time. Dishwashers have been developed in relatively recent times as one type of such automatic washers and have been distributed to a number of homes.

While there are various types of dishwashers, a majority of dishwashers is permanently installed according to the installing method. A permanently-installed dishwasher may be installed integrally with a piece of kitchen cabinetry, for example, a sink or a sink cabinet, for the purpose of space saving. When such a dishwasher is installed, a connecting device connecting the dishwasher to the kitchen equipment may be used.

However, connecting devices of the related art have the following problems and thus improvements are required. For example, such connecting devices may not be suitable to be used with a variety of dishwashers, the shape, structure, installation method, or the like of which slightly varies depending on the manufacture. In some cases, some connecting devices may fail to withstand the weight of the dishwasher installation work, due to insufficient strength thereof, thereby restricting the installation work. Therefore, there has been demand for technological approaches able to more effectively overcome such problems.

The foregoing is intended merely to aid in the understanding of the background of the present disclosure, and is not intended to mean that the present disclosure falls within the purview of the related art that is already known to those skilled in the art.

SUMMARY

Accordingly, the present disclosure has been made keeping in mind the above problems occurring in the related art, and the present disclosure is intended to propose a dishwasher fixing bracket apparatus for fixing a dishwasher in a place in which the dishwasher is installed.

However, the objective of the present disclosure is not limited to the aforementioned description, and other objectives not explicitly disclosed herein will be clearly understood by those skilled in the art to which the present disclosure pertains from the description provided hereinafter In order to achieve the above objective, according to one aspect of the present disclosure, there is provided a dishwasher fixing bracket apparatus including: a base bar having a flat top surface, and including a slide rail provided on a bottom thereof and extending in a longitudinal direction thereof; and a plurality of moving plates slidably coupled to the slide rail and configured to change positions thereof on the base bar in the longitudinal direction of the base bar, wherein the plurality of moving plates includes: a pair of outer plates each including a support strap protruding in a direction of a corresponding one of distal ends of the base bar, the support strap having a coupling hole through which the support strap is coupled to an external structure and being oriented toward an adjacent one of the distal ends of the base bar; and one or more inner plates configured to slide between the outer plates and having fixing holes through which the inner plates are coupled to the dishwasher.

The slide rail may protrude downward from the base bar, and the outer plates and the inner plates may be disposed on the slide rail with a height different such that the inner plates are lower than the outer plates.

The slide rail may include: a perpendicular section extending perpendicularly downward from an edge of the base bar; and a hooked section bent inward of the base bar from an outer edge of the perpendicular section. The inner plates may be in close contact with the hooked section. Each of the inner plates may have first perpendicular edges formed on edges thereof and protruding upward to support the base bar. The outer plates may be spaced apart from the hooked section. Each of the outer plates may have second perpendicular edges formed on edges thereof and protruding downward to support the hooked section.

The slide rail may include a pair of slide rails disposed on both edges of the base bar such that the slide rails are symmetrical to each other. The plurality of moving plates may be inserted between the slide rails to be parallel to the top surface of the base bar.

The fixing hole may include a plurality of fixing holes spaced apart from each other. Each of the fixing holes may protrude to be higher than surfaces of the inner plates due to punching performed in a bottom-to-top direction.

The dishwasher fixing bracket apparatus may further include movement limiting protrusions provided on the distal ends of the base bar and extending downward to be able to intersect the moving plates, thereby preventing the moving plates from being detached from the base bar.

The length of a portion of the support strap exposed from the base bar may vary depending on a position of the outer plates.

The support strap may have one or more recesses formed on edges thereof. The recesses may be indented inward to reduce the width of the support strap.

The inner plates may include a plurality of inner plates, at least one of which is configured to overlap a dishwasher connecting strap in a one-to-one relationship.

Each of the outer plates may have auxiliary fixing holes through which outer plates are screw-coupled to the dishwasher.

According to the present disclosure, it is possible to very firmly fix a dishwasher to an external structure, such as kitchen equipment, using the dishwasher fixing bracket apparatus according to the present disclosure. In particular, the dishwasher fixing bracket apparatus according to the present disclosure may be properly used with a variety of dishwasher, the shape, structure, or the like of which are partially different, in order to facilitate dishwasher installation work. In addition, the dishwasher fixing bracket apparatus may effectively support a heavy dishwasher, due to the increased strength thereof. Thus, during or after the installation of the dishwasher, the dishwasher fixing bracket apparatus may provide high structural stability between the dishwasher and the surrounding structure. Accordingly, it is possible to more conveniently and reliably perform the dishwasher installation work using the dishwasher fixing bracket apparatus according to the present disclosure.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
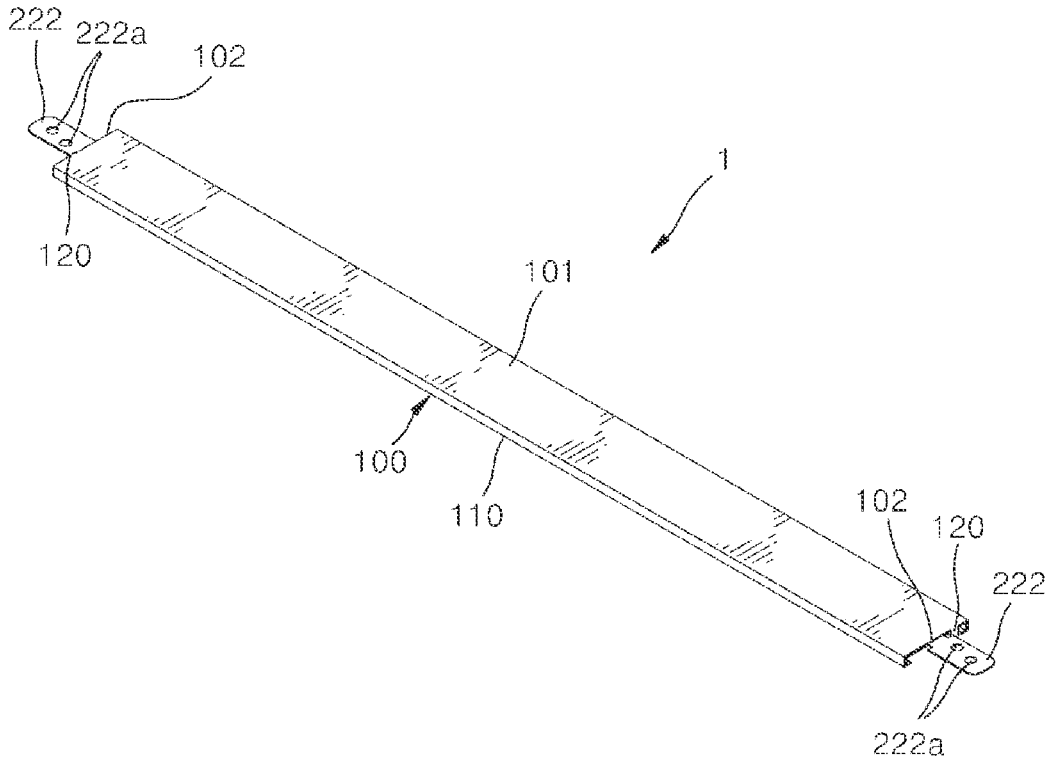
FIG. 1 is a perspective view illustrating a dishwasher fixing bracket apparatus according to an embodiment of the present disclosure, viewed in one direction.

The above and other objectives, features, and advantages of the present disclosure will be more clearly understood from the following detailed description when taken in conjunction with the accompanying drawings. However, the present disclosure is not limited to specific embodiments to be described hereinafter but may be embodied in a variety of different forms. Rather, these embodiments are provided so that the description of the present disclosure will be complete and will fully convey the scope of the present disclosure to those skilled in the technical field to which the present disclosure pertains. The present disclosure shall be defined by the scope of the claims. Throughout the specification, the same reference numerals will be used throughout to designate the same or like components.

Hereinafter, a dishwasher fixing bracket apparatus according to the present disclosure will be described in detail with reference to FIGS. 1 to 13.

Figure 2:
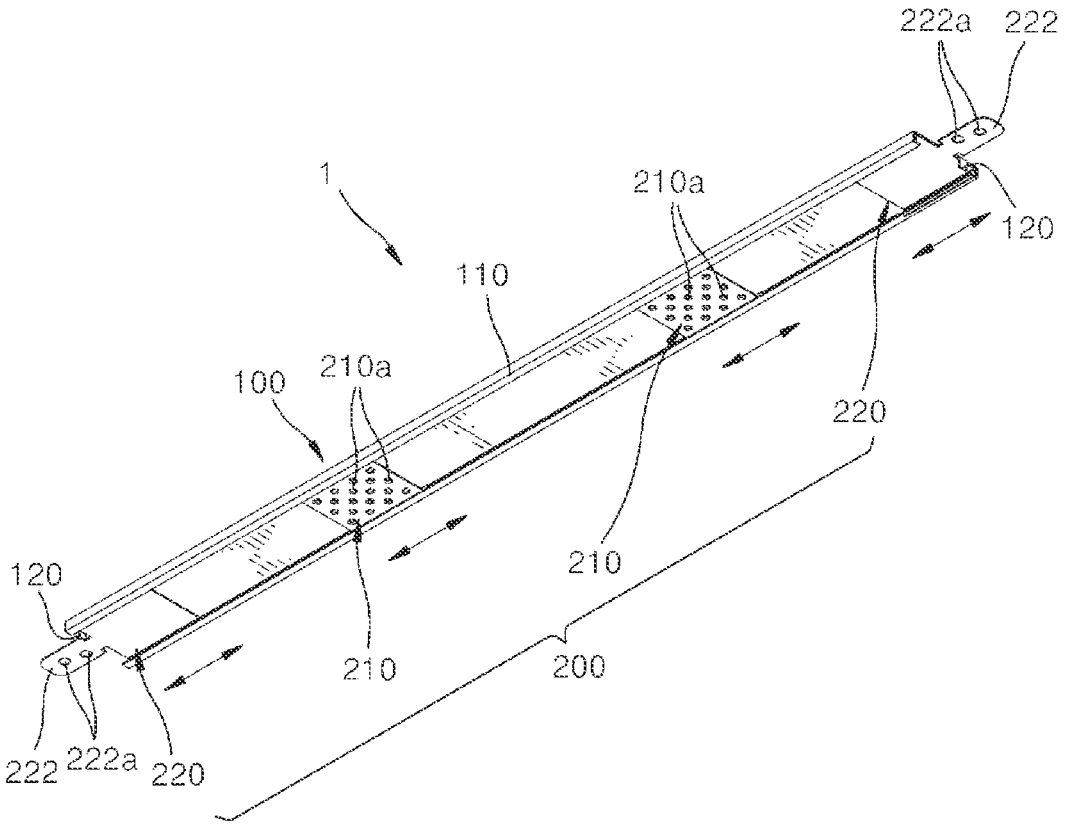
FIG. 2 is a perspective view of the dishwasher fixing bracket apparatus illustrated in FIG. 1, viewed in another direction.

FIG. 1 is a perspective view illustrating a dishwasher fixing bracket apparatus according to an embodiment of the present disclosure, viewed in one direction; FIG. 2 is a perspective view of the dishwasher fixing bracket apparatus illustrated in FIG. 1, viewed in another direction; and FIG. 3 is a front view of the dishwasher fixing bracket apparatus illustrated in FIG. 1.

Figure 3:
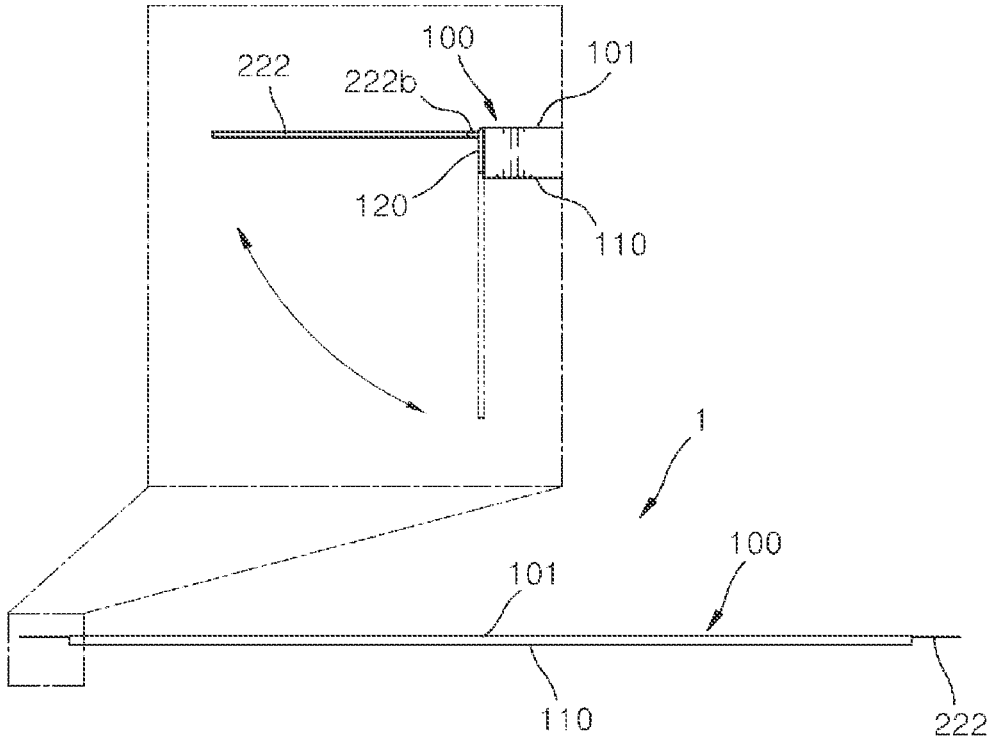
FIG. 3 is a front view of the dishwasher fixing bracket apparatus illustrated in FIG. 1.

Referring to FIGS. 1 to 3, a dishwasher fixing bracket apparatus 1 according to the present disclosure includes a plurality of moving plates 200 (see FIG. 2) coupled to a base bar 100. Each of the moving plates 200 may slide along the base bar 100 so that each moving plate 200 may be coupled to the dishwasher at a variety of points while changing the position thereof. Thus, the present disclosure may be properly applied to a variety of other dishwashers, the shapes, structures, or the like of which are partially different, and thus an operation of installing may be performed very easily. In addition, a coupling structure of the base bar 100 and the moving plates 200 provides a double-support structure comprised of two structures engaged with each other to increase strength, as well as a sliding function. Thus, the overall strength of the dishwasher fixing bracket apparatus 1 is drastically increased. Thus, a very heavy dishwasher may be reliably supported, and the dishwasher may reliably remain connected to an external structure.

The dishwasher fixing bracket apparatus 1 according to the present disclosure is configured as follows. In the dishwasher fixing bracket apparatus 1, the base bar 100 has a flat top surface 101 (see FIG. 1), and includes slide rails 110 formed on the bottom thereof to extend in the longitudinal direction thereof. Each of the plurality of moving plates 200 is slidably coupled to the slide rails 110 so as to be able to change the position thereof on the base bar 100 in the longitudinal direction of the base bar 100. The plurality of moving plates 200 includes a pair of outer plates 220 (see FIG. 2) and one or more inner plates 210 (see FIG. 2). Each of the pair of outer plates 200 includes a support strap 222 protruding in the direction of a corresponding one of distal ends 102 (see FIG. 1) of the base bar 100 and having coupling holes 222*a* through which the support strap 222 is coupled to the external structure. The support strap 222 is oriented toward the adjacent one of the distal ends 102 of the base bar 100. Each of the inner plates 210 is configured to slide between the outer plates 220, and has fixing holes 210*a* (see FIG. 2) through which the inner plate 210 is coupled to the dishwasher. As illustrated in FIG. 2, a pair of inner plates 210 may be provided. However, this is merely an embodiment, and the number of the inner plates 210 may vary in other embodiments. Hereinafter, the configurations, functions, and effects of the present disclosure will be described in more detail with reference to the respective drawings.

Figure 4:
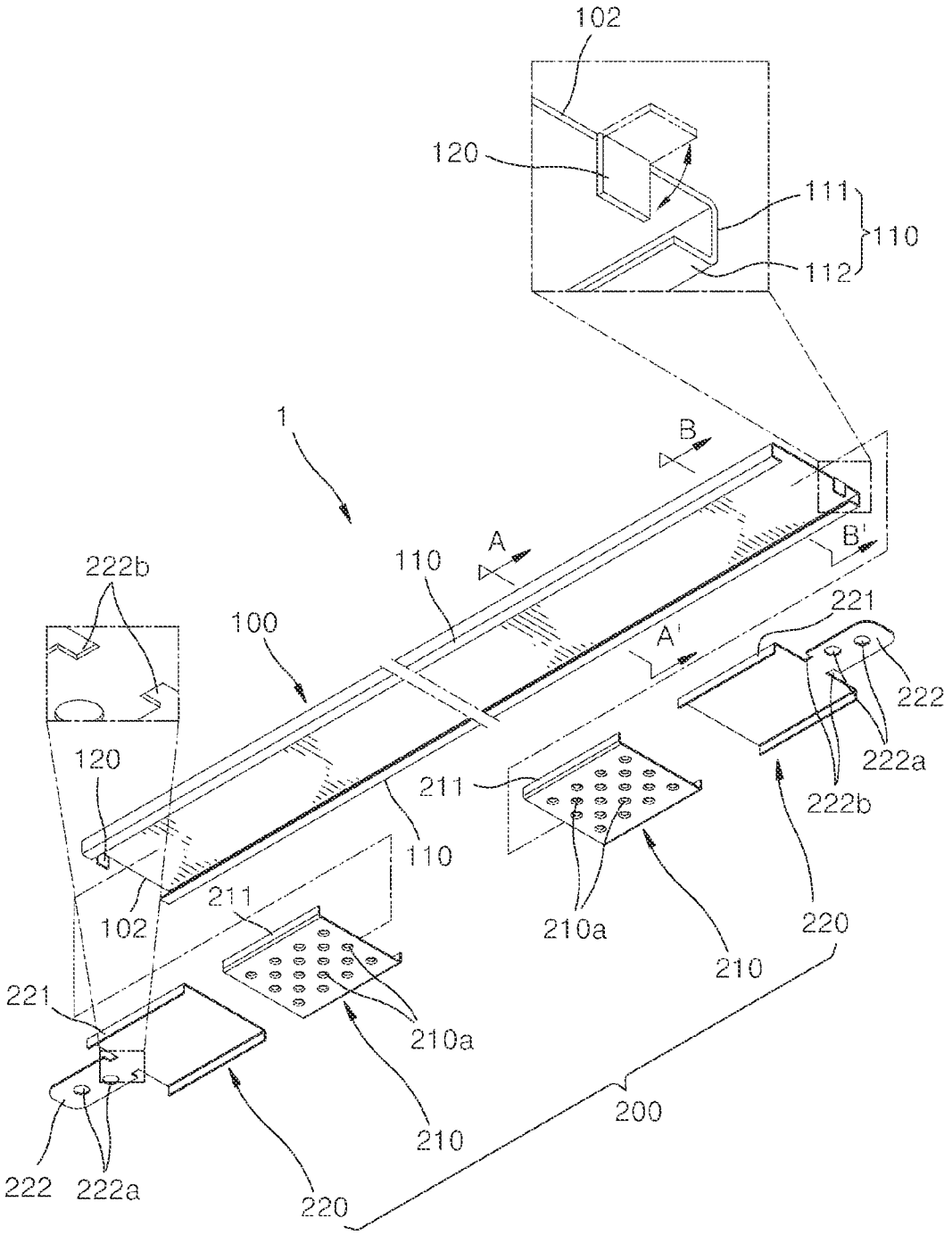
FIG. 4 is an exploded perspective view of the dishwasher fixing bracket apparatus illustrated in FIG. 1.
Figure 5:
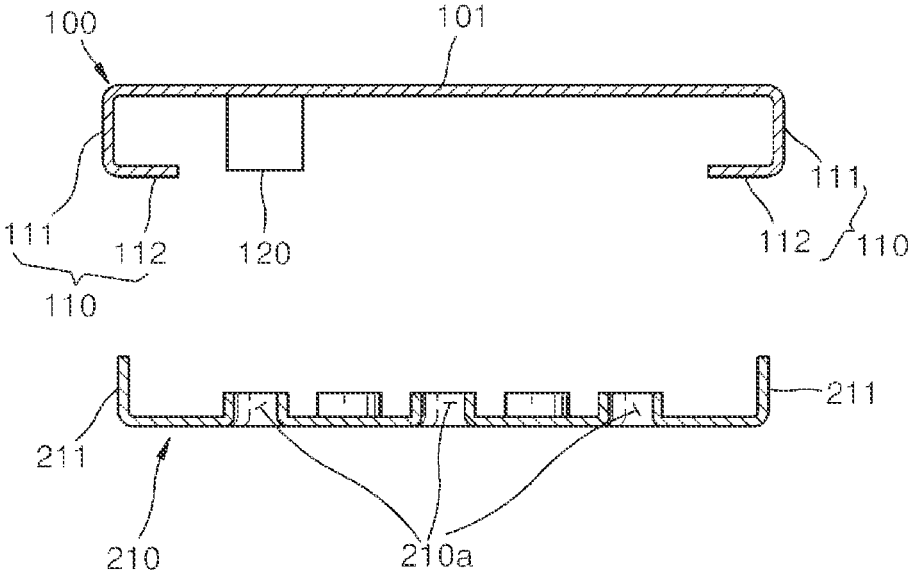
FIG. 5 is a cross-sectional view of the dishwasher fixing bracket apparatus illustrated in FIG. 4, taken along the line A-A'.
Figure 6:
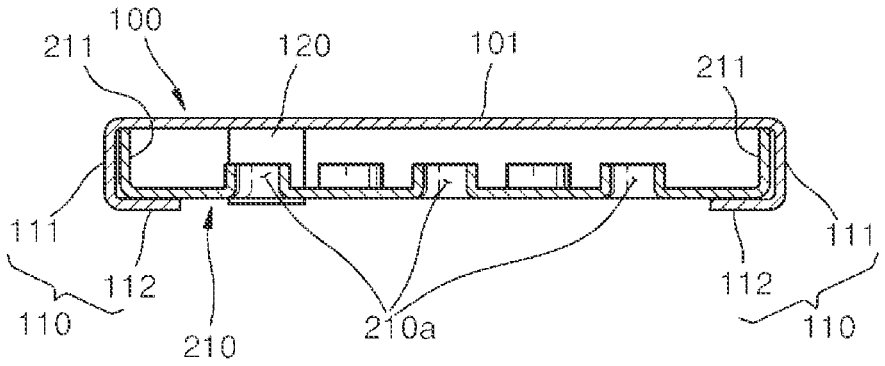
FIG. 6 is an assembled cross-sectional view of the dishwasher fixing bracket apparatus illustrated in FIG. 5.
Figure 7:
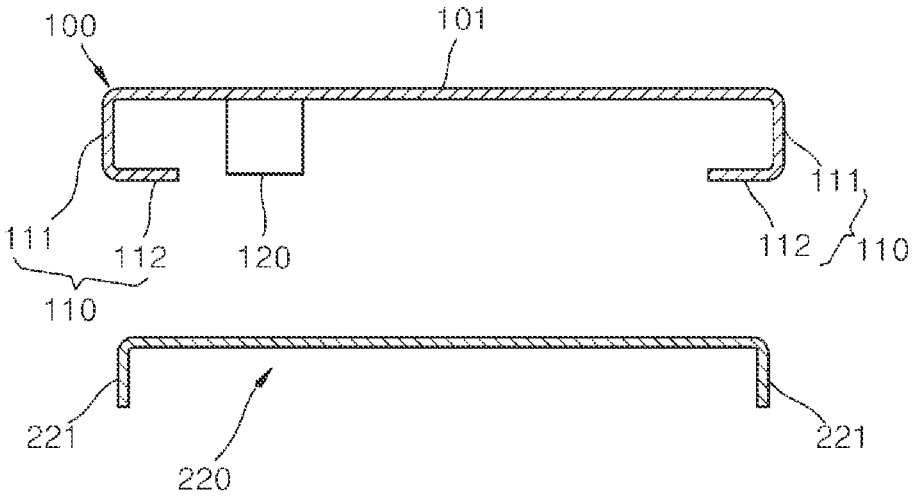
FIG. 7 is a cross-sectional view of the dishwasher fixing bracket apparatus illustrated in FIG. 4, taken along the line B-B'.
Figure 8:
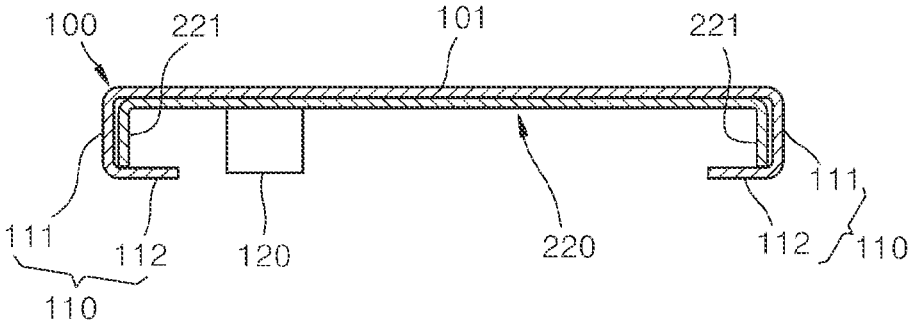
FIG. 8 is an assembled cross-sectional view of the dishwasher fixing bracket apparatus illustrated in FIG. 7.

FIG. 4 is an exploded perspective view of the dishwasher fixing bracket apparatus illustrated in FIG. 1, FIG. 5 is a cross-sectional view of the dishwasher fixing bracket apparatus illustrated in FIG. 4, taken along the line A-A', FIG. 6 is an assembled cross-sectional view of the dishwasher fixing bracket apparatus illustrated in FIG. 5, FIG. 7 is a cross-sectional view of the dishwasher fixing bracket apparatus illustrated in FIG. 4, taken along the line B-B', and FIG. 8 is an assembled cross-sectional view of the dishwasher fixing bracket apparatus illustrated in FIG. 7.

Hereinafter, the combination relationships, structures, operations, and the like of the components will be more clearly demonstrated by referring to FIGS. 1 to 3 illustrating the entirety of the dishwasher as well as the exploded and cross-sectional views of FIGS. 4 to 8. First, a description will be given with reference to the exploded and cross-sectional views of FIGS. 4 to 8. The base bar 100 may serve as a support structure that forms a fundamental part of the dishwasher fixing bracket apparatus 1 while supporting the moving plates 200. As illustrated in FIG. 1, the base bar 100 may have an elongated shape extending in one direction, and may have the shape of a bar with the width thereof being smaller than the length thereof. The top surface 101 of the base bar 100 is flat as illustrated in FIGS. 1, 3, and 5, and the slide rails 110 extending in the longitudinal direction are provided on the bottom of the base bar 100 as illustrated in FIG. 2. That is, the base bar 100 is configured such that the slide rails 110 are combined to a plate-shaped structure including the flat top surface 101. For example, the base bar 100 may be provided by integrally molding the plate-shaped body in which the flat top surface 101 is formed and the slide rails 110 extending in the longitudinal direction. The base bar 100 may be made from a metal material. However, the present disclosure is not limited thereto and the base bar 100 may be made from any of the other materials as required. The base bar 100 may be made from a composite material made up of two or more distinct components. In addition, the base bar 100 may be used by preparing a variety of bars having different lengths and replacing one of the prepared bars with another one as required. In this manner, the length of the dishwasher fixing bracket apparatus 1 may be adjusted to an appropriate length.

The slide rails 110 protrude downward from the base bar 100. As illustrated in FIGS. 5 to 8, the slide rails 110 may protrude downward from a side surface of the base bar 100 on which the flat top surface 101 is formed. The slide rails 110 protrude downward from the base bar 100, and the moving plates 200, i.e., the outer plates 220 and the inner plates 210, coupled to the base bar 100, may be disposed on the slide rails 110 with a height different such that the inner plates 210 are lower than the outer plates 220 (see FIGS. 5 to 8). Thus, the top surface 101 at a relatively high position supports the external structure such as a sink or a sink cabinet, and the outer plates 220 located at a relatively high position are conveniently coupled to the external structure through the support straps 222. In contrast, the inner plates 210 located at a relatively low position may be conveniently coupled to the dishwasher through the fixing holes 210*a*. In addition, when the flat top surface 101 is used, uniform pressure may be applied to a bonding member, such as tape, having a two-dimensional structure. Thus, the dishwasher fixing bracket apparatus 1 may be firmly fixed to the external structure using tape in place of an adhesive. A specific installation process related to this feature will be described in more detail below. A pair of slide rails 110 is disposed on both edges of the base bar 100 such that the slide rails 110 of the pair are symmetrical to each other, as illustrated in FIG. 2. The plurality of moving plates 200 may be inserted between the paired slide rails 110 to be parallel to the top surface 101 of the base bar 100.

As illustrated in FIG. 4, each of the slide rails 110 may have a three-dimensional shape including perpendicular sections 111 protruding perpendicularly from the flat body of the base bar 100 and hooked sections 112 (see the enlarged view). The perpendicular sections 111 and the hooked sections 112 correspond to first perpendicular edges 211 and second perpendicular edges 221 formed on the inner plates 210 and the outer plates 220 and enclose portions of the moving plates 200, thereby forming a double-support structure together with the moving plates 200. For example, each of the slide rails 110 includes the perpendicular section 111 extending perpendicularly downward from one edge of the base bar 100 and the hooked section 112 bent inward of the base bar 100 from the outer edge of the perpendicular section 111, as illustrated in FIG. 4. The inner plates 210 are in close contact with the hooked section 112. Each of the inner plates 210 has the first perpendicular edges 211 on edges thereof, the first perpendicular edges 211 protruding upward to support the base bar 100. The outer plates 220 are spaced apart from the hooked sections 112. Each of the outer plates 220 may have the second perpendicular edges 221 on edges thereof, the second perpendicular edges 221 protruding downward to support the hooked section 112. These features will be described in more detail with reference to FIGS. 5 to 8. For example, the first perpendicular edges 211 may protrude perpendicularly upward from both edges of the inner plates 210, as illustrated in FIG. 5. The perpendicular sections 111 of the rail 110 may protrude perpendicularly downward from both edges of the base bar 100. Since the first perpendicular edges 211 and the perpendicular section 111 are formed at corresponding positions, the perpendicular section 111 may overlap the first perpendicular edges 211 while being parallel to the outer surfaces of the first perpendicular edges 211 in the coupled position as illustrated in FIG. 6. In this position, the first perpendicular edges 211 support the base bar 100 from inside while the perpendicular sections 111 enclose the first perpendicular edges 211 from outside. Portions of the inner plates 210 are in close contact with the hooked section 112. Thus, the hooked sections 112 are caught by the inner plates 210, thereby preventing the inner plates 210 from being detached. At the same time, the inner plates 210 are pressed toward the base bar 100 by the hooked section 112. Consequently, the strong double-support structure in which the outside perpendicular sections 111 and the inside first perpendicular edges 211 overlap each other is provided.

In addition, the second perpendicular edges 221 protrude perpendicularly downward from both edges of the outer plates 220 as illustrated in FIG. 7. The second perpendicular edges 221 may also be formed at positions corresponding to the perpendicular sections 111 so as to overlap the perpendicular sections 111. That is, the second perpendicular edges 221 are formed at positions corresponding to those of the perpendicular sections 111 while being oriented opposite the first perpendicular edges 211, such that the perpendicular sections 111 may overlap the second perpendicular edges 221 while being parallel to the outer surfaces of the second perpendicular edges 221 in the coupled position as illustrated in FIG. 8. In this position, the second perpendicular edges 221 support the hooked sections 112 therebelow, and the perpendicular sections 111 enclose the second perpendicular edges 221 from outside. Thus, the hooked sections 112 prevent the entirety of the outer plates 220 from being detached, and the surfaces of the outer plates 220 are brought into close contact toward the base bar 100. Consequently, the strong support structure in which the outside perpendicular sections 111, the hooked sections 112 and the inside second perpendicular edges 221 are in a double-overlapping relationship and the outer plates 220 and the base bars 100 are in a double-overlapping relationship is provided. In particular, according to this structure, the inner plates 210 and the outer plates 220 may be connected to the first perpendicular edges 211 and the second perpendicular edges 221 protruding in opposite directions, i.e., upward and downward, respectively. Thus, the inner plates 210 and the outer plates 220 may be disposed at different heights as described above, That is, the slide rails 110 have a structure in which the hooked sections 112 enclose the inner plates 210 and the outer plates 220 so as to reinforce the structural stability of the entirety of the moving plates 200. In this structure, when pressure is applied from above or below, the components are brought into stronger contact with each other, thereby increasing support force. That is, the perpendicular sections 111 of the slide rails 110 and the first perpendicular edges 211 and the second perpendicular edges 221 of the moving plates 200 serve as double-support bodies that are substantially double-arranged in the perpendicular direction. Thus, the dishwasher fixing bracket apparatus 1 may sufficiently withstand pressure applied from the dishwasher and pressure applied from an external structure such as a sink or a sink cabinet. In addition, since the dishwasher fixing bracket apparatus 1 includes this strong support structure, the heavy dishwasher or the like may be firmly fixed, and deformation, such as twisting, may be prevented by the support structure. Consequently, stable support force may be provided for an extended period of time.

The plurality of moving plates 200 is provided as illustrated in FIG. 2. Each of the plurality of moving plates 200 may be slidably coupled to the above-described slide rails 110 to change the position on the base bar 100 in a longitudinal direction. That is, at least one of the plurality of moving plates 200 may be moved as required, thereby providing a more accurate coupling structure according to the structure or shape of the dishwasher. The moving plates 200 may have the fixing holes 210*a* through which the moving plates 200 are coupled to the pair of outer plates 220 and the dishwasher, and may include one or more inner plates 210 slidable between the pair of outer plates 220. As described above, due to the first perpendicular edges 211 (see FIG. 4) formed on the inner plates 210 and the second perpendicular edges 221 (see FIG. 4) formed on the outer plates 220, the moving plates 200 provide the strong double-support structure together with the slide rails 110. Since these features have been described above, the remaining features of the moving plates 200 will be described in more detail with reference to the respective drawings.

As illustrated in FIGS. 2 and 4, the plurality of moving plates 200 include the pair of outer plates 220 and the one or more inner plates 210 movable between the outer plates 220. Although the pair of inner plates 210 is illustrated, the number of the inner plates 210 may be properly changed. Thus, this feature is not necessarily limited to the drawings. Each of the pair of outer plates 200 includes the support strap 222 protruding in the direction of the corresponding distal end 102 (see FIG. 1) of the base bar 100 and having the coupling holes 222*a* through which the support strap 222 is coupled to the external structure. The support strap 222 is oriented toward the adjacent distal end 102 of the base bar 100. For example, one of the outer plates 220 having the support strap 222 protruding to the left may be disposed on the left distal end of the base bar 100, while the other one of the outer plates 220 having the support strap 222 protruding to the right may be disposed on the right distal end of the base bar 100. Since the outer plates 220 are also slidably coupled to the slide rails 110, the positions thereof are adjustable. Thus, as illustrated in FIG. 2, when the outer plates 220 are pushed toward the both distal ends 102 of the base bar 100 adjacent thereto, the respective support straps 222 protrude from the base bar 100. As illustrated in FIG. 3, the support straps 222 protruding from the base bar 100 may be folded in use. As described above, the outer plates 220 (see FIGS. 2 and 4) are disposed higher than the inner plates 210 (see FIGS. 2 and 4) so as to be substantially in close contact with the base bar 100. Thus, the support straps 222 extending from the outer plates 220 may also be folded or unfolded at a height substantially the same as that of the base bar 100. Accordingly, when the base bar 100 is brought into close contact with the external structure or the like to supports the external structure or the like, the support strap 222 may be more easily brought into contact with and coupled to the external structure or the like.

The support strap 222 may be made from a metal material or the like, and may be folded or unfolded by applying external force thereto. The support strap 222 is not required to be fixed to a specific shape, and the shape of the support strap 222 may be freely changed in use depending on the space of an installation area or the shape of the external structure or the like. The support strap 222 may have a variety of shapes. For example, as illustrated in FIGS. 3 and 4, the support strap 222 may have one or more recesses 222*b* formed on edges thereof, the recesses 222*b* being indented inward to reduce the width of the support strap 222. Thus, the support strap 222 may be more easily bent about a portion where the recesses 222*b* are formed. As illustrated in the FIG. 4, a pair of recesses 222*b* may be disposed on both edges of the support strap 222 such that the recesses 222*b* face each other. The number, arrangement, or the like of the recesses 222*b* may be changed as required.

The inner plates 210 each include the fixing holes 210*a* as illustrated in FIG. 4, and form the double-coupling structure due to the slide rails 110 and the first perpendicular edges 211 as described above. The outer plates 220 also form the double-coupling structure due to the second perpendicular edges 221. Thus, the double coupling structure between the base bar 100 and the moving plates 200 is formed at a plurality of points where the outer plates 220 and the inner plates 210 are coupled to the slide rails 110, respectively. Accordingly, the strength of the entirety of the dishwasher fixing bracket apparatus 1 may be significantly increased, and the dishwasher fixing bracket apparatus 1 may maintain the original structure without being substantially influenced by deformation, such as twisting. As described above, the inner plates 210 may be disposed at positions lower than those of the outer plates 220, and may be disposed substantially in close contact with the hooked sections 112, i.e. the outer edges of the slide rails 110. That is, the inner plates 210 may be disposed on the lowest portions of the slide rails 110 provided on the bottom of the base bar 100. Thus, the base bar 100 may be coupled to the dishwasher disposed therebelow while being more closely in contact therewith.

In addition, since the plurality of moving plates 200 may freely slide along the slide rails 110, the movement of the plurality of moving plates 200 is required to be limited at the distal ends 102 of the base bar 100 so that the plurality of moving plates 200 is not detached from the base bar 100. For example, as illustrated in the figures, movement limiting protrusions 120 may be provided on the distal ends 102 of the base bar 100 in order to limit the movement of the moving plates 200. The movement limiting protrusions 120 may be formed on the both distal ends 102 (see FIG. 1) of the base bar 100 and extend downward to be able to intersect the moving plates 200, thereby preventing the moving plates 200 from being detached from the base bar 100. The movement limiting protrusions 120 may be formed by, for example, extending portions of the base bar 100, and may be folded or unfolded by applying an appropriate amount of force thereto. For example, as illustrated in FIG. 4, after the moving plates 200 are inserted into the slide rails 110 by spreading the movement limiting protrusions 120, the movement limiting protrusions 120 may be folded so as to prevent the moving plates 200 from being detached therefrom. When the movement limiting protrusions 120 are adjusted in this manner, the base bar 100 and the moving plates 200 may be easily separated from and coupled to each other. Each of the movement limiting protrusions 120 may be disposed at a position at which the movement limiting protrusion 120 does not intersect any of the support straps 222, and thus, the movement limiting protrusions 120 may not collide with the support straps 222. One or more movement limiting protrusions 120 with a suitable size may be formed on each of the distal ends 102 of the base bar 100. For example, the movement limiting protrusions 120 may be made from a metal material or the like.

As illustrated in FIG. 4, the plurality of fixing holes 210*a* of the inner plates 210 are spaced apart from each other. The plurality of fixing holes 210*a* may be arranged on the inner plates 210 in a variety of patterns. Each of the fixing holes 210*a* may be formed by punching in a bottom-to-top direction so as to protrude to be higher than the surface of the inner plate 210. Describing FIGS. 5 and 6 in more detail, for example, the fixing holes 210*a* may be located higher than the surfaces of the inner plates 210, due to punching performed in the bottom-to-top direction. Each of the fixing holes 210*a* may be surrounded by upwardly-protruding portions of the inner plates 210. Thus, screws or the like may be more firmly coupled to the fixing holes 210*a*. That is, it is possible to more firmly fix the coupling members, such as screws, using the fixing holes 210*a* punched three-dimensionally. Each of the inner plates 210 and the outer plates 220 may be made from a metal material. For example, the fixing holes 210*a* may be formed by the same method as that of punching the metal plate of the inner plates 210. When each of the inner plates 210 and the outer plates 220 is made from a metal material, the first perpendicular edges 211 and the second perpendicular edges 221 may be formed integrally with the inner plates 210 and the outer plates 220 by, for example, a method of refracting portions of the metal plates. However, the present disclosure is not limited thereto. Rather, moving plates 200 may be made of a different material, and the moving plates 200 may be formed by combining two or more materials.

Figure 9:
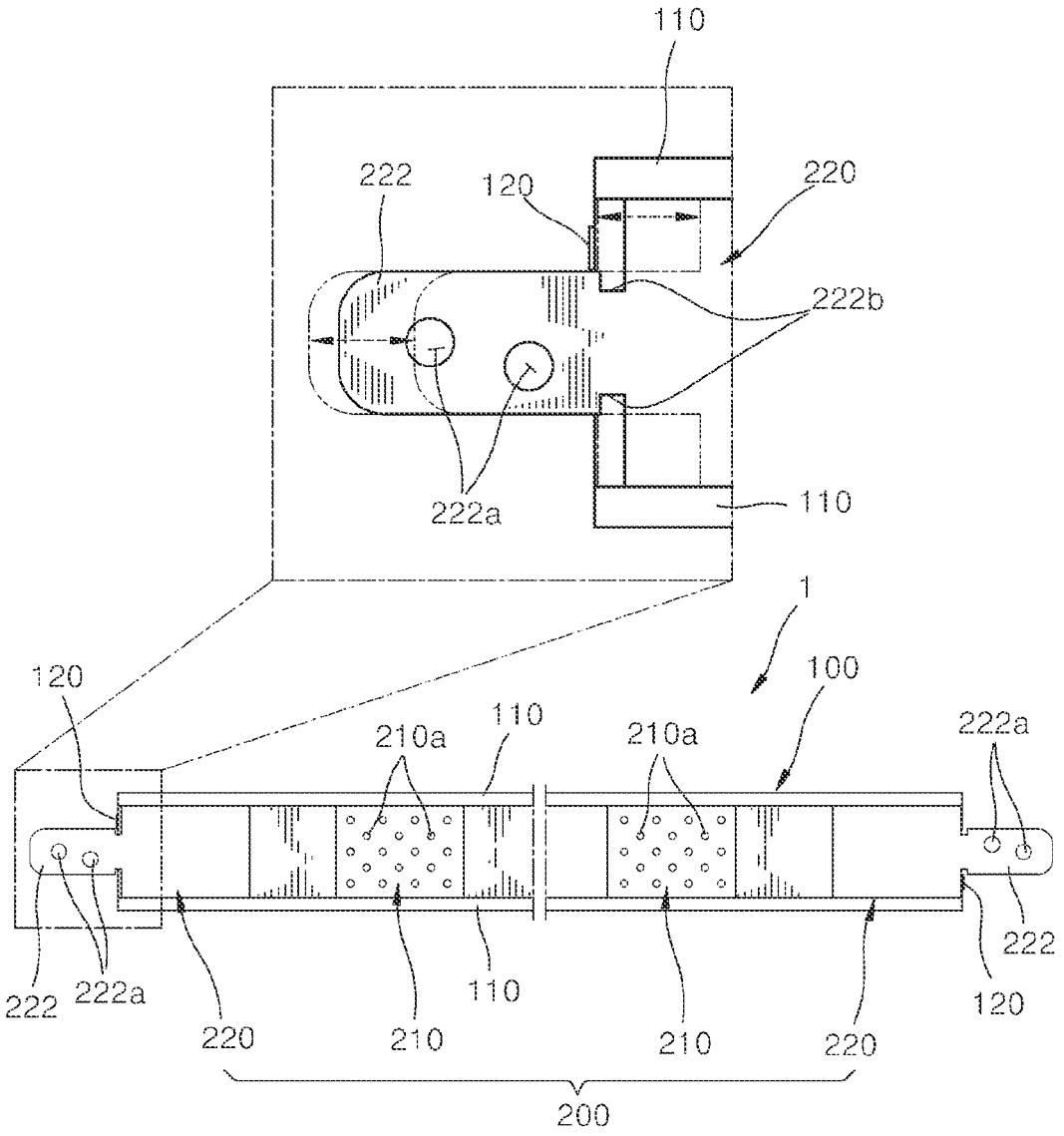
FIG. 9 is a bottom view of the dishwasher fixing bracket apparatus illustrated in FIG. 1.
Figure 10:
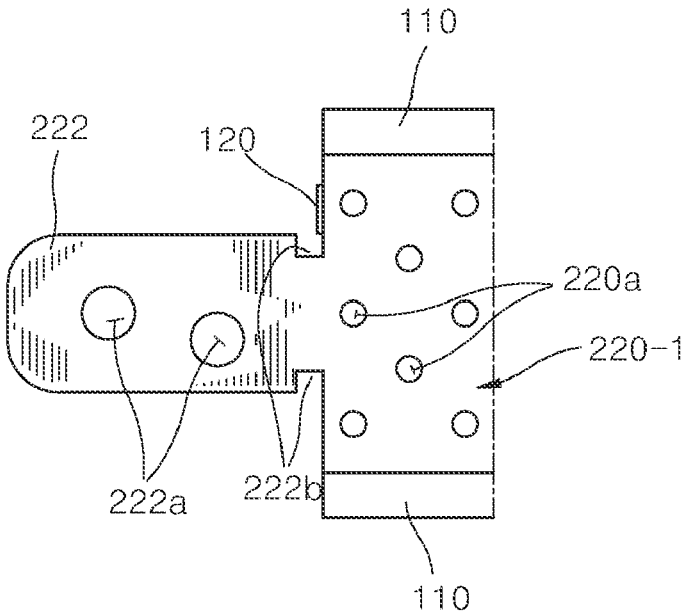
FIG. 10 is a view illustrating a modified embodiment of the outer plate.
Figure 11:
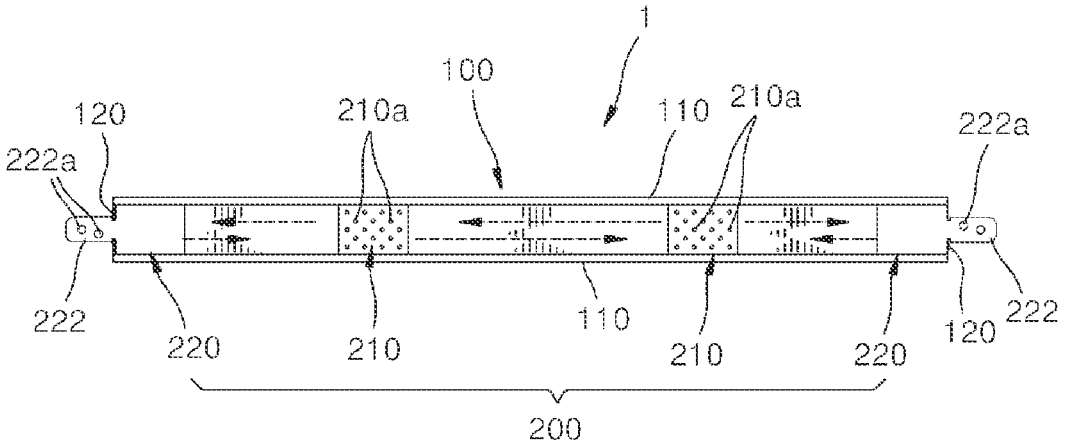
FIG. 11 is a view illustrating the operation of the moving plates of the dishwasher fixing bracket apparatus illustrated in FIG. 1.

FIG. 9 is a bottom view of the dishwasher fixing bracket apparatus illustrated in FIG. 1, FIG. 10 is a view illustrating a modified embodiment of the outer plate, and FIG. 11 is a view illustrating the operation of the moving plates of the dishwasher fixing bracket apparatus illustrated in FIG. 1.

According to such structural features, the dishwasher fixing bracket apparatus 1 may be used by appropriately changing the shape thereof according to a variety of situation. For example, the length of the portion of the support strap 222 exposed from the base bar 100 may vary depending on the position of the outer plate 220. The support strap 222 has the coupling holes 222*a* through which the support strap 222 is coupled to the external structure, and the coupling position thereof may change depending on the situation. The length of the support strap 222 may be accurately adjusted to an appropriate length by changing the position of the outer plate 220. For example, when the dishwasher fixing bracket apparatus 1 is mounted in a specific space (see FIG. 12), the entire length of the dishwasher fixing bracket apparatus 1 may be adjusted according to the corresponding space by accurately adjusting the exposed length of the support strap 222. In addition, since the length of the base bar 100 itself is adjustable by replacement or the like as described above, the entirety of the dishwasher fixing bracket apparatus 1 may be installed in a very accurate manner according to the size of the space. Although the support strap 222 is illustrated as being spread in FIG. 9, the outer plates 220 may be fitted to the space by moving in a position in which the support straps 222 are folded. In this case, as described above, the support straps 222 may be easily folded using the recesses 222*b* formed thereon. Since the numbers and positions of the coupling holes 222*a* and the recesses 222*b* are merely illustrative, the numbers and positions may be adjusted as required. In this manner, the dishwasher fixing bracket apparatus 1 may be easily applied to a variety of spaces by adjusting at least one of the length of the dishwasher fixing bracket apparatus 1 and the exposed lengths of the support straps 222.

Referring to FIG. 10, a portion of an outer plate 220-1 may be deformed. That is, as required, the outer plate 220-1 may include auxiliary fixing holes 220*a* through which outer plate 220-1 may be screw-coupled to the dishwasher. The auxiliary fixing holes 220*a* may have a variety of shapes through which coupling members, such as a screw, may pass. The auxiliary fixing holes 220*a* may not necessarily have the same shape or structure as the fixing holes 210*a* or the like as described above (see FIG. 4). The number, arrangement, or the like of the auxiliary fixing holes 220*a* may be properly adjusted. For example, in a situation in which it is intended to form more fixing points at which the dishwasher is fixed at different positions, the auxiliary fixing holes 220*a* may be useful. As described above, the auxiliary fixing holes 220*a* may be formed in the outer plate 220-1 as required.

The moving plates 200 may be more accurately coupled to the dishwasher by freely moving the positions of the moving plates 200 as illustrated in FIG. 11. While the outer plates 220 are movable within the limit in which the support straps 222 are allowed to be in contact with the external structure, the inner plates 210 may more freely move between the outer plates 220. Thus, a more accurate coupling position may be set by adjusting the inner plates 210. That is, a plurality of inner plates 210 is disposed, and at least one of the plurality of inner plates 210 may overlap a dishwasher connecting strap in a one-to-one relationship. Thus, it is possible to firmly fix the dishwasher by moving the inner plates 210 to positions corresponding to the connecting strap formed on the dishwasher side. Hereinafter, a related process of installing the dishwasher will be described in more detail with reference to FIGS. 12 and 13.

Figure 12:
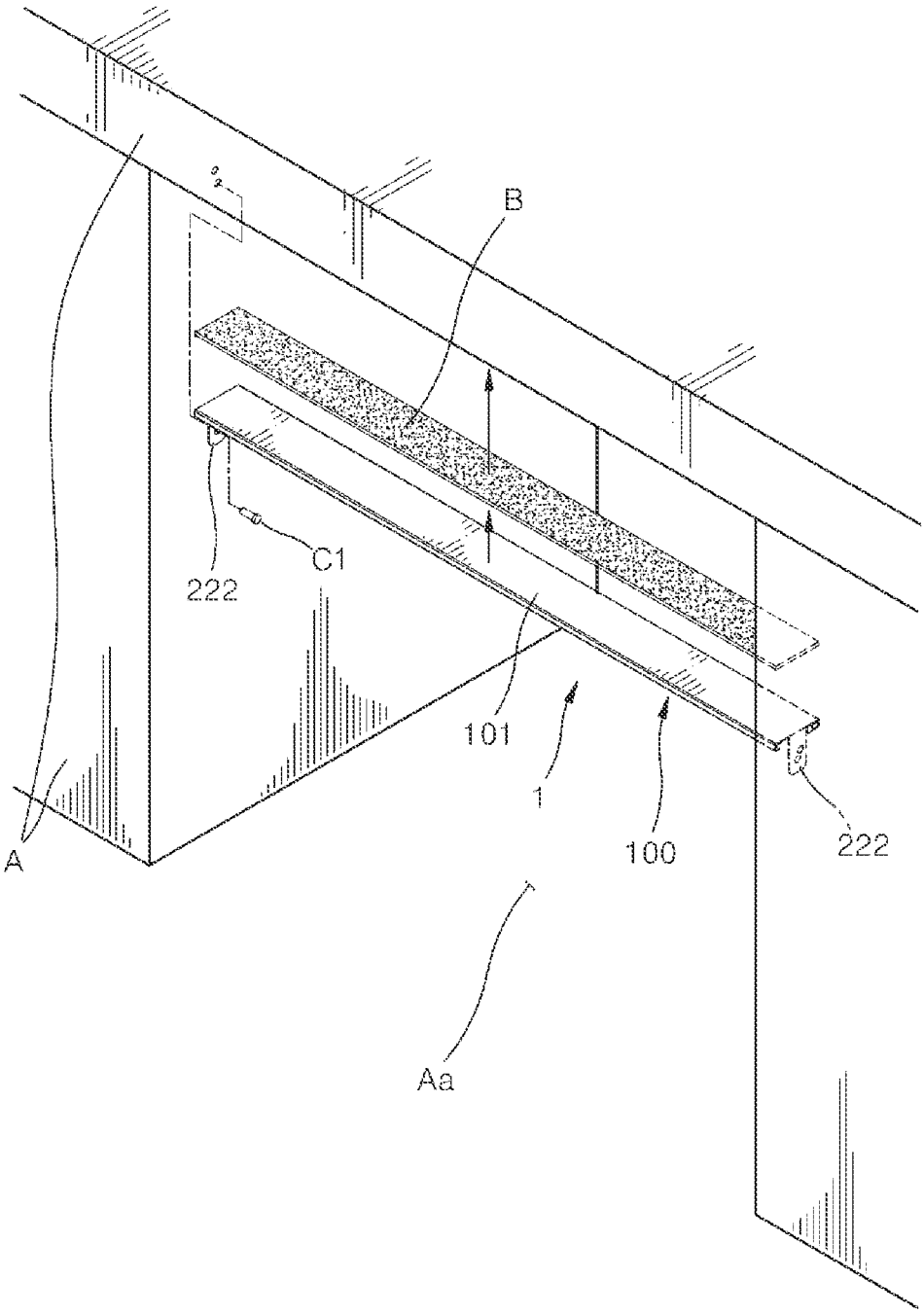
FIGS. 12 and 13 are views sequentially illustrating a process of installing a dishwasher using the dishwasher fixing bracket apparatus illustrated in FIG. 1.
Figure 13:
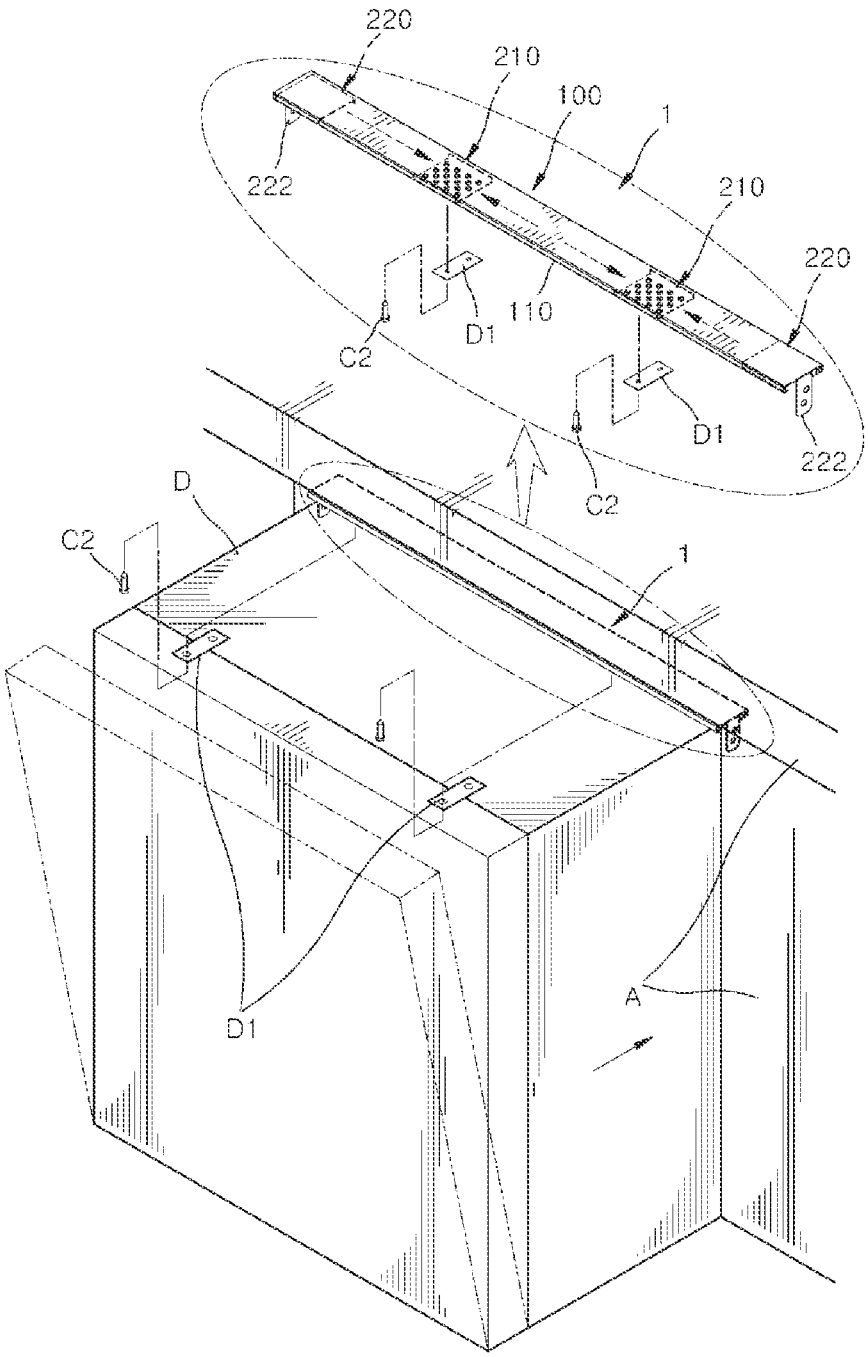

FIGS. 12 and 13 are views sequentially illustrating the process of installing a dishwasher using the dishwasher fixing bracket apparatus illustrated in FIG. 1.

Referring to FIG. 12, the dishwasher fixing bracket apparatus 1 may be disposed in a space Aa defined by an external structure A. The external structure A may be comprised of a sink and a cabinet below the sink in the kitchen, and the space Aa may be formed by removing a portion of the cabinet. First, the dishwasher fixing bracket apparatus 1 is disposed in the space Aa. For example, it is possible to bring the support strap 222 of the dishwasher fixing bracket apparatus 1 into close contact with the external structure A by folding the support strap 222 of the dishwasher fixing bracket apparatus 1. It is possible to fix the dishwasher fixing bracket apparatus 1 to the external structure A by coupling a screw C1 to the support strap 222. As described above, it is possible to install the dishwasher fixing bracket apparatus 1 to accurately fit to the space Aa by accurately adjusting the length of the support strap 222. Here, double-sided tape B may be inserted between the top surface 101 of the base bar 100 and the external structure A, and the double-sided tape B may be effectively brought into close contact with the external structure A by pressing the entirety of the double-sided tape B using the flat top surface 101 as described above. That is, as described above, the dishwasher fixing bracket apparatus 1 may be firmly installed using a two-dimensional bonding member, such as tape, or the screw C1 or the like, instead of using an adhesive or the like as described above.

Afterwards, as illustrated in FIG. 13, the dishwasher D is inserted into the space Aa (see FIG. 12) and is fixed by coupling the dishwasher connecting straps D1 and the moving plates 200. (In general, the connecting strap D1 is coupled to the inner plates 210 having the fixing holes 210*a* (see FIG. 4) or the like. However, when the outer plate 220-1 includes the auxiliary fixing hole 220*a* (see FIG. 10) as in the modified embodiment in FIG. 10, the outer plate 220-1 may also be used for the coupling.) In particular, the inner plates 210 may be slid to overlap the dishwasher connecting straps D1 in a one-to-one relationship, thereby more firmly coupling screws C2 to the more accurate position. For example, the dishwasher fixing bracket apparatus 1 may be located adjacent to the door of the dishwasher D, and in a position in which dishwasher D is accommodated in the space, the dishwasher fixing bracket apparatus 1 may be exposed when the door or the like is opened. Thus, the inner plates 210 may be slid to overlap the dishwasher connecting straps D1 in a one-to-one relationship. In addition, since the outer plates 220 are movable, the positions thereof may be adjusted as required. Although the dishwasher connecting straps D1 may be located adjacent to the door of the dishwasher D, the dishwasher connecting straps D1 may be disposed to overlap the connecting strap D1 as illustrated in FIG. 13 by properly adjusting the entirety of the moving plates 200, since the number or distance of the doors may vary according to the manufacturer. The screws C2 may be coupled to the dishwasher D by extending through the dishwasher connecting straps D1 and the moving plates 200. (i.e., The screws C2 may be coupled to the dishwasher D by extending through the connecting straps D1 and the inner plates 210 having the fixing holes 210*a* (see FIG. 4) or the like, and in a situation, such as the modified embodiment in FIG. 10, in which the outer plate 220-1 includes the auxiliary fixing holes 220*a* (see FIG. 10), the outer plates 220 may be used as required.) The dishwasher connecting strap D1 may be formed in the dishwasher D or may be attached to, for example, holders for fixing the dishwasher D. Even in the case that the positions of the dishwasher connecting straps D1 are varied in this manner, it is possible to slide the moving plates 200 to overlap the connecting strap D1 and, in this position, couple the moving plates 200 and the connecting strap D1 using the screws C2. In addition, damage to the external structure A by screws C2 passing through the fixing holes 210*a* of the moving plates 200 can be avoided by the base bar 100 with a flat top surface 101.

As set forth above, it is possible to very conveniently and firmly fix the dishwasher D. In addition, the strength of the dishwasher fixing bracket apparatus 1 is increased by the above-described double-support structure of the base bar 100 and the moving plates 200, and thus, the dishwasher fixing bracket apparatus 1 may more firmly fix the dishwasher D and provide the stable support structure for an extended period of time.

Although the exemplary embodiments of the present disclosure have been described for illustrative purposes, those skilled in the art will appreciate that various modifications, additions, and substitutions are possible, without departing from the technical idea and essential features of the present disclosure as disclosed in the accompanying claims. Therefore, the embodiments explained herein should be interpreted as being illustrative in all aspects while not being limitative.

What is claimed is:

1. A dishwasher fixing bracket apparatus comprising:

a base bar having a flat top surface, and comprising a slide rail provided on a bottom thereof and extending in a longitudinal direction thereof; and a plurality of moving plates slidably coupled to the slide rail and configured to change positions thereof on the base bar in the longitudinal direction of the base bar, the plurality of moving plates comprising:

a pair of outer plates each comprising a support strap protruding in a direction of a corresponding one of distal ends of the base bar, the support strap having a coupling hole through which the support strap is coupled to an external structure and being oriented toward an adjacent one of the distal ends of the base bar; and one or more inner plates configured to slide between the pair of outer plates and having fixing holes through which the one or more inner plates are configured to be coupled to a dishwasher, wherein the slide rail comprises:

a perpendicular section extending perpendicularly downward from an edge of the base bar; and a hooked section bent inward of the base bar from an outer edge of the perpendicular section, wherein the one or more inner plates are in close contact with the hooked section, and each have first perpendicular edges formed on edges thereof and protruding upward to support the base bar; and the pair of outer plates are spaced apart from the hooked section, and each have second perpendicular edges formed on edges thereof and protruding downward to support the hooked section.

2. The dishwasher fixing bracket apparatus of claim 1, wherein the slide rail comprises a pair of slide rails disposed on both edges of the base bar such that the slide rails are symmetrical to each other, and the plurality of moving plates is inserted between the slide rails to be parallel to the top surface of the base bar.

3. The dishwasher fixing bracket apparatus of claim 2, wherein the fixing hole comprises a plurality of fixing holes spaced apart from each other, each of the fixing holes protruding to be higher than surfaces of the one or more inner plates due to punching performed in a bottom-to-top direction.

4. The dishwasher fixing bracket apparatus of claim 1, further comprising movement limiting protrusions provided on the distal ends of the base bar and extending downward to be able to intersect the plurality of moving plates, thereby preventing the plurality of moving plates from being detached from the base bar.

5. The dishwasher fixing bracket apparatus of claim 1, wherein the length of a portion of the support strap exposed from the base bar varies depending on a position of the pair of outer plates.

6. The dishwasher fixing bracket apparatus of claim 1, wherein the support strap has one or more recesses formed on edges thereof, the one or more recesses being indented inward to reduce the width of the support strap.

7. The dishwasher fixing bracket apparatus of claim 1, wherein the one or more inner plates comprise a plurality of inner plates, at least one of which is configured to overlap a dishwasher connecting strap in a one-to-one relationship.

8. The dishwasher fixing bracket apparatus of claim 1, wherein each of the pair of outer plates has auxiliary fixing holes through which the pair of outer plates are configured to be screw-coupled to the dishwasher.

* * * * *